US005514220A

United States Patent [19]

Wetmore et al.

[11] Patent Number: 5,514,220

[45] Date of Patent: May 7, 1996

[54] PRESSURE PULSE CLEANING

[76] Inventors: Paula M. Wetmore, 5 S. Webster St., Bradford, Mass. 01835; Val J. Krukonis, 287 Emerson Rd., Lexington, Mass. 02173; Michael P. Coffey, 5 Blood Rd., Townsend, Mass. 01469

[21] Appl. No.: 988,196

[22] Filed: Dec. 9, 1992

[51] Int. Cl.[6] ..... B08B 9/093

[52] U.S. Cl. ..... 134/22.18

[58] Field of Search ..... 134/17, 22.12, 134/40, 22.18

[56] References Cited

U.S. PATENT DOCUMENTS 5,013,366 5/1991 Jackson et al. ..... 134/40
5,267,455 12/1993 Dewees et al. ..... 68/5 C

OTHER PUBLICATIONS

NASA Technical Brief MFS–29611; Motyl; "Cleaning Metal Substrates Using Liquid/Supercritical Fluid Carbon Dioxide" (odd pages) (Mar. 1979).

*Primary Examiner*—Gary P. Straub
*Assistant Examiner*—Thomas G. Dunn, Jr.
*Attorney, Agent, or Firm*—Kane, Dalsimer, Sullivan, Kurucz, Levy, Eisele and Richard

[57] ABSTRACT

The present invention is a method which relies on pressure pulse cleaning. By "pressure pulse cleaning" it is meant that the pressure and temperature of a fluid, such as carbon dioxide is raised to near or above supercritical conditions, which is then contacted with the item(s) to be cleaned. Periodically, the pressure of the supercritical fluid is pulsed or spiked to higher levels and returned to substantially the original level. Potential candidates for treatment by the present invention include but are not limited to precision parts such as gyroscopes used in missile guidance systems, accelerometers, thermal switches, nuclear valve seals, electromechanical assemblies, polymeric containers, special camera lenses, laser optics components, and porous ceramics.

5 Claims, 1 Drawing Sheet

PRESSURE PULSE CLEANING

FIELD OF THE INVENTION

This invention is directed towards a method for cleaning items by a method utilizing the solvent capabilities of supercritical fluids, such as supercritical carbon dioxide.

BACKGROUND OF THE INVENTION

Supercritical fluids are known to exhibit a variety of properties, including enhanced solvent properties. Mc Hugh, Krukonis, *Supercritical Fluids: Principles and Practice* (Butterworths, Boston, Mass., 1986) co-authored by one of the inventors of the present invention, is an extensive overview of the properties and applications of supercritical solvents. Supercritical fluids are effective at separating low vapor pressure oils, fractionation of polymers, preparation of submicron particles of pharmaceutical compounds and explosives, cholesterol extraction from eggs, and other applications in the chemical and petroleum industries.

With respect to cleaning items such as electronic circuit boards and precision parts, processes relying upon chlorofluorocarbons (CFC's) are known in the art. However, CFC's are not acceptable because of the environmental and health adversities associated therewith. CFC's are a documented source of ozone depletion. For this reason, alternatives to CFC processes must be developed.

One alternative is the use of supercritical carbon dioxide for the removal of organic and oil-based contaminants. Processes relying upon supercritical carbon dioxide are known in the art. However, the art recognized methods are not sufficient insofar as they do not adequately clean porous materials or materials which exhibit tight clearances between adjoining components. Similar problems exist with swellable materials, such as polymers from which undesirable components must be removed.

SUMMARY OF THE INVENTION

It is an object of the present invention to provide a method for cleaning items utilizing supercritical fluids such as supercritical carbon dioxide.

It is a further object of the invention to provide a method for cleaning precision parts utilizing supercritical fluids such as supercritical carbon dioxide.

It is a still further object of the invention to provide an improved method for cleaning interstices on objects exhibiting porous surfaces, tight clearances, or are otherwise swellable.

Other objects shall become apparent from the disclosure of the invention which follows.

The present invention is a method which relies on pressure pulse cleaning. By "pressure pulse cleaning" it is meant that the pressure and temperature of a fluid, such as carbon dioxide is raised to near or above supercritical conditions, which is then contacted with the item(s) to be cleaned. Periodically, the pressure of the supercritical fluid is pulsed or spiked to higher levels and returned to substantially the original level. This cycle continues a selected number of times.

Potential candidates for treatment by the present invention include but are not limited to precision parts such as gyroscopes used in missile guidance systems, accelerometers, thermal switches, nuclear valve seals, electromechanical assemblies, polymeric containers, special camera lenses, laser optics components, and porous ceramics.

It should be understood that the method of the present invention is suitable for cleaning all items cleaned by prior art methods. However, the method exceeds the prior art methods when the items to be treated are characterized by interstices. That is, when such items are cleaned by the present invention and the prior art methods, the present invention will outperform the prior art methods and remove a greater amount of contaminant or will remove the contaminants with less supercritical fluid. This will particularly be the case within the interstices of the treated items, as the present invention has shown itself to be better suited than the prior art methods in cleaning hard-to-reach places.

DETAILED DESCRIPTION OF THE PREFERRED EMBODIMENT

Figure 1:
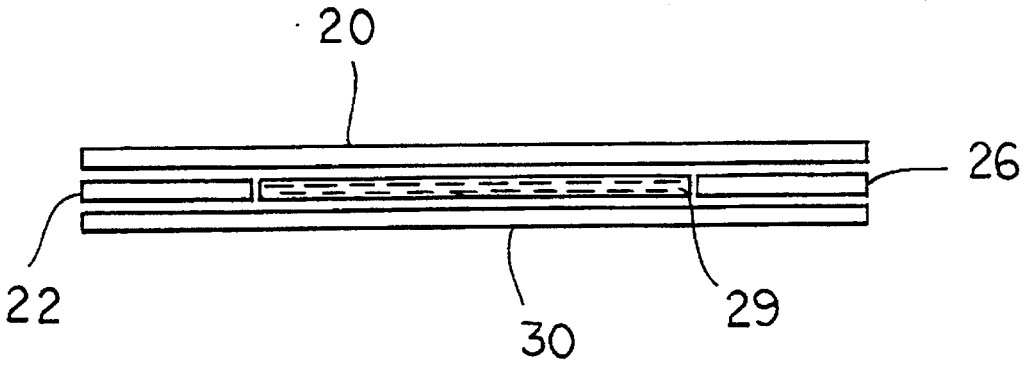
FIG. 1 is a schematic of the model used in the example.

Generally describing the method, the item(s) to be cleaned are place within a stainless steel vessel. Suitable vessels can be obtained from Newport Scientific, Jessup, MD. or Pressure Products, Warminster, Pa. For smaller components 60 ml. and 3 l. vessels are suitable.

The temperature and/or pressure of a suitable fluid, such as carbon dioxide, is raised so that the fluid is in a supercritical state. The fluid is introduced into the vessel. The interaction of the supercritical fluid with the item, and particularly any undesirable contaminant upon the item, results in the dissolving of the contaminant into the supercritical fluid. The pressure of the supercritical fluid is raised periodically to a predetermined peak pressure. Pressure can be raised by increasing the flow rate into the vessel but holding the rate of removal at a rate lower than flow rate entering the vessel. The fluid exits the vessel, whereupon it is depressurized to 1 atm. Depressurization effects a precipitation of the contaminant, which is collected in a trap for analysis or for discarding.

The preferred supercritical fluid is carbon dioxide, however other fluids such as light hydrocarbons are also suitable. Supercritical carbon dioxide will dissolve dirt and contaminants such as silicone oils, hydrocarbons, waxes, gyroscope oils, and other organic undesirables.

The skilled artisan will realize the temperature and/or pressure conditions necessary to bring the fluid to a supercritical state.

In raising or spiking the pressure of the supercritical fluid, it is preferred that the practitioner raise the pressure to a level at least 1500 psi greater than the initial pressure of the supercritical fluid. Properties of supercritical fluids such as density, viscosity, and diffusivity are highly pressure dependent and by varying pressure over a wide range (ie-a large delta) such as 1500 psi these properties vary significantly as well as thereby improving cleaning efficiencies. Of particular importance is the change in fluid density as pressure is changed.

In raising or spiking the pressure of the supercritical fluid, the practitioner could raise the pressure to a predetermined level, and then commence to decrease the pressure. Following this technique, and further raising and decreasing the pressure at the same constant rate and further raising the pressure to the same predetermined level followed by decreasing the pressure to the same initial level will effect a pressure profile resembling a sine wave of constant frequency. A skilled artisan would realize that deviations from this pressure profile are possible. A different technique is to raise the pressure to a predetermined level and hold steady for a period of time before decreasing it. This profile would resemble a square wave. Again, the skilled artisan would realize that variations on this technique are possible. The skilled artisan could even combine these two techniques into a hybrid method. Other profiles include ascending ramp and descending ramp.

For items which have relatively large pores or no pores, it has been found that cleaning can be accomplished with greater rapidity than with constant pressure flow using the same amount of total gas. For items which exhibit close tolerances, such as submicron tolerances, between segments and interstitial regions, complete removal of contaminants can be accomplished in situations where complete removal may be impossible with constant pressure flow with any commercially acceptable volume of fluid.

The following example illustrates the process.

EXAMPLE

The cleaning method of the present invention was compared to the prior art constant pressure cleaning method. Tests were conducted on model parts that simulate crevices, pores, and joint lines. FIG. 1 schematically shows such a model part. The model part is constructed of sheet metal and shim stock. The face dimension is 2.5"×0.5×1/16". Stainless steel faces 20 and 30 are each 1/16" thick respectively, sandwich shim stocks 22 and 26 which are 0.001" thick. The shim stocks are also constructed of stainless steel. Prior to sandwiching and clamping fluid bromotrifluoroethylene (BTFE) 29 is placed upon one stainless steel sheet, the shim stocks are arranged, and the second stainless steel sheet is positioned and the model is clamped. Excess BTFE is forced out by clamping and wiped from the exterior surfaces.

Prior to extraction, the model was weighed. The model described above was subjected to treatments by both the method of the present invention and by the prior art constant pressure method. For both treatments 600 standard liters of $CO_2$ was used. For the constant pressure tests, runs were conducted at 1500, 3000, and 6000 psi. Two runs were made for pressure pulse tests. The first run was conducted with a pressure of 1500 psi and increased to 3000 psi and decreased to 1500 psi. In the second run pressure was initially 1500 psi, increased to 6000 psi, and decreased to 1500 psi. After treatment the part was weighed to determine the amount of residual oil. The degree of oil removal is set forth below in the table.

| CONSTANT PRESSURE Test Pressure (psi) | | | | PRESSURE PULSE Test Pressure Range (psi) | | |
|---|---|---|---|---|---|---|
| Test Temp. | 1500 | 3000 | 6000 | Test Temp. | 1500–3000 | 1500–6000 |
| 50° C. | 64% | 78% | 83% | 50° C. | 94% | 100% |
| 80° C. | 58% | 80% | 87% | 80° C. | 100% | 100% |

It can be seen for the above data that for the same volume of gas, pressure pulse cleaning accomplishes considerably better results, Hence, in a much shorter period of time, pressure pulse cleaning accomplishes what would take considerably longer using the prior art constant pressure method.

We claim:

1. A method for cleaning items using supercritical fluids comprised of the steps of:

selecting a fluid;and raising the fluid to an initial supercritical state;

introducing the suprcritical fluid to at least one item to be cleaned in a vessel;

raising the pressure of the introduced supercritical fluid to effect a higher density supercritical state;

depressurizing the supercritical fluid in the higher density supercritical state to a lower density supercritical state, the raising and depressurizing of the supercritical fluid occurring at substantially constant temperature;

repeating the raising of the pressure and depressurizing at least once;

removing the supercritical fluid from the vessel and collecting a contaminant that was present within the supercritical fluid.

2. The method of claim 1 wherein the higher density supercritical state is at least 1500 psi higher than the pressure of the introduced supercritical fluid.

3. The method of claim 1 wherein the supercritical fluid is carbon dioxide.

4. The method of claim 1 wherein the at least one item has interstices.

5. The method of claim 1 wherein the at least one item is selected from the group consisting of gyroscopes, accelerometers, thermal switches, nuclear valve seals, electromechanical assemblies, polymeric containers, laser optics components, and porous ceramics.

* * * * *